US011324258B2

(12) United States Patent
Batista et al.

(10) Patent No.: US 11,324,258 B2
(45) Date of Patent: May 10, 2022

(54) AEROSOL-GENERATING DEVICE WITH AN INDUCTION HEATER WITH A CONICAL INDUCTION COIL

(71) Applicant: Philip Morris Products S.A., Neuchatel (CH)

(72) Inventors: Rui Nuno Batista, Morges (CH); Tony Reevell, London (GB)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 16/636,941

(22) PCT Filed: Aug. 6, 2018

(86) PCT No.: PCT/EP2018/071262
§ 371 (c)(1),
(2) Date: Feb. 6, 2020

(87) PCT Pub. No.: WO2019/030168
PCT Pub. Date: Feb. 14, 2019

(65) Prior Publication Data

US 2020/0236998 A1 Jul. 30, 2020

(30) Foreign Application Priority Data

Aug. 9, 2017 (EP) ..... 17185560

(51) Int. Cl.
*A24F 13/00* (2006.01)
*A24F 40/465* (2020.01)
(Continued)

(52) U.S. Cl.
CPC ..... *A24F 40/465* (2020.01); *A24F 40/57* (2020.01); *A24F 40/85* (2020.01); *H05B 6/108* (2013.01); *A24F 40/20* (2020.01)

(58) Field of Classification Search
CPC ..... A24F 47/00
(Continued)

(56) References Cited

U.S. PATENT DOCUMENTS

2015/0223292 A1 8/2015 Duffield et al.
2017/0055574 A1 3/2017 Kaufman et al.
(Continued)

FOREIGN PATENT DOCUMENTS

CN 105307526 A 2/2016
CN 205624487 U 10/2016
(Continued)

OTHER PUBLICATIONS

International Search Report and Written Opinion dated Nov. 6, 2018 in PCT/EP2018/071262 filed on Aug. 6, 2018.
(Continued)

*Primary Examiner* — Phuong K Dinh
(74) *Attorney, Agent, or Firm* — Oblon, McClelland, Maier & Neustadt, L.L.P.

(57) ABSTRACT

An aerosol-generating device is provided, including a housing having a chamber configured to receive at least a portion of an aerosol-generating article, the chamber including at least one solid elongate heating element extending into the chamber in a longitudinal direction of the chamber and being configured to penetrate an aerosol-generating article received in the chamber, the heating element having a conical shape and being tapered at a free end thereof; an induction coil disposed around at least a portion of the chamber and having a conical shape; and a power supply and a controller connected to the induction coil and being configured to provide an alternating electric current to the induction coil such that the inductor coil generates a fluctuating magnetic field for heating the heating element disposed in the chamber.

15 Claims, 7 Drawing Sheets

(51) Int. Cl.

| | |
|---|---|
| ***A24F 40/57*** | (2020.01) |
| ***H05B 6/10*** | (2006.01) |
| ***A24F 40/85*** | (2020.01) |
| *A24F 40/20* | (2020.01) |

(58) Field of Classification Search
USPC ..... 131/328–329
See application file for complete search history.

(56) References Cited

U.S. PATENT DOCUMENTS

| | | | | |
|---|---|---|---|---|
| 2017/0055580 | A1 | 3/2017 | Blandino et al. | |
| 2018/0184712 | A1* | 7/2018 | Fraser | A24F 40/44 |
| 2018/0206295 | A1 | 7/2018 | Duffield et al. | |
| 2018/0249760 | A1 | 9/2018 | Kaufman et al. | |
| 2018/0279681 | A1* | 10/2018 | Rojo-Calderon | A24C 5/01 |
| 2018/0289067 | A1* | 10/2018 | Courbat | H05B 6/108 |
| 2018/0310623 | A1* | 11/2018 | Batista | A24F 40/465 |

FOREIGN PATENT DOCUMENTS

| | | | |
|---|---|---|---|
| GB | 2504732 | A | 2/2014 |
| WO | 2016/120177 | A1 | 8/2016 |
| WO | WO 2017/068101 | A1 | 4/2017 |
| WO | WO 2018/138072 | A1 | 8/2018 |

OTHER PUBLICATIONS

Office Action dated Feb. 26, 2021 in corresponding European Patent Application No. 18 746 726.1, 3 pages.
Russian Office Action dated Oct. 20, 2021 in corresponding Russian Patent Application No. 2020105877 (English translation only), 6 pages.

* cited by examiner

AEROSOL-GENERATING DEVICE WITH AN INDUCTION HEATER WITH A CONICAL INDUCTION COIL

CROSS-REFERENCE TO RELATED APPLICATIONS

This application is a U.S. national stage application of PCT/EP2018/071262 filed on Aug. 6, 2018, which is based upon and claims the benefit of priority from European patent application no. 17185560.4, filed Aug. 9, 2017, the entire contents of each of which are incorporated herein by reference.

TECHNICAL FIELD

Description of the Related Art

The present invention relates to an aerosol-generating device having a chamber configured to receive at least a portion of an aerosol-generating article. The device comprises an induction coil, a power supply and a controller for providing an alternating electric current to the induction coil.

It is known to employ different types of heaters in aerosol-generating articles for generating an aerosol. Typically, resistance heaters are employed for heating an aerosol-forming substrate such as an e-liquid. It is also known to provide "heat not burn" devices utilizing resistance heaters, which generate an inhalable aerosol by heating but not burning an aerosol-forming substrate containing tobacco.

Induction heaters offer advantages and have been proposed in the above devices. Induction heaters are for example described in US 2017/055580 A1. In induction heaters, an induction coil is arranged around a component made from a conductive material. The component may be denoted as a heating element or susceptor. A high-frequency AC current is passed through the induction coil. As a result, an alternating magnetic field is created within the induction coil. The alternating magnetic field penetrates the heating element thereby creating eddy currents within the heating element. These currents lead to a heating of the heating element. In addition to heat generated by eddy currents, the alternating magnetic field may also cause the susceptor to heat due to the hysteresis mechanism. Some susceptors may even be of a nature that no, or almost no, eddy currents will take place. In such susceptors substantially all the heat generation is due to hysteresis mechanisms. Most common susceptors are of such a kind, where heat is generated by both mechanisms. A more elaborate description of the processes and responsible for generating heat in a susceptor, when penetrated by an alternating magnetic field may be found in WO2015/177255. Inductive heaters facilitate rapid heating which is beneficial for generating an aerosol during the operation of the aerosol-generating device.

It would be desirable to have an aerosol-generating device with an induction heater which can be heated in a controlled manner and which is easy to clean.

SUMMARY

According to a first aspect of the invention there is provided an aerosol-generating device comprising a housing having a chamber configured to receive at least a portion of an aerosol-generating article. The chamber preferably comprises at least one heating element the heating element being a solid, elongate heating element extending into the chamber in a longitudinal direction of the chamber and configured to penetrate the aerosol-generating article received in the chamber. The heating element preferably has a conical shape and is tapered at its free end. The device comprises an induction coil disposed around at least a portion of the chamber and having a conical shape. The device further comprises a power supply and a controller connected to the induction coil and configured to provide an alternating electric current to the induction coil such that, in use, the inductor coil generates a fluctuating magnetic field for heating a heating element located in the chamber.

BRIEF DESCRIPTION OF THE DRAWINGS

The invention will be further described, by way of example only, with reference to the accompanying drawings in which.

DETAILED DESCRIPTION

Figure 1:
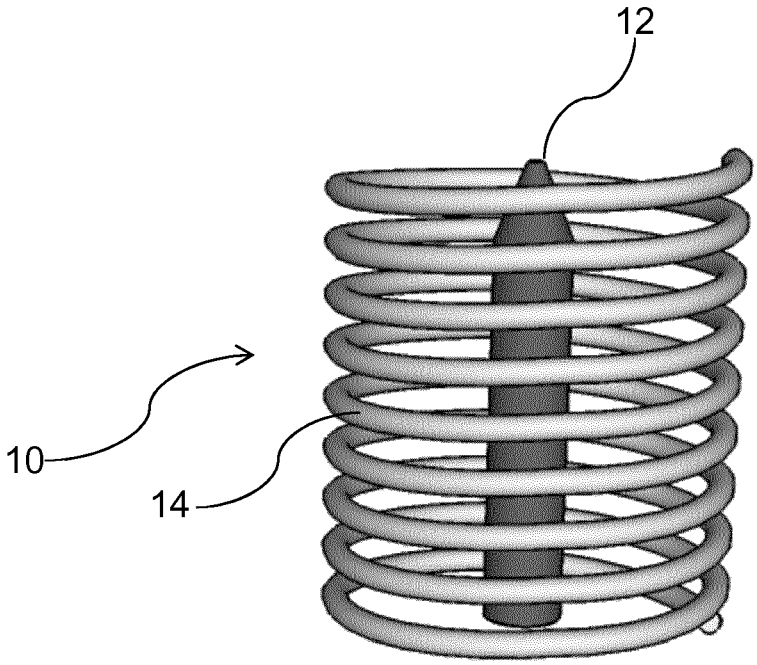
FIG. 1 shows a conventional induction heater.

By providing a conical shaped induction coil, the heating characteristics of the heating element can be controlled. In this regard, the distance between the induction coil and the heating element influences the heat generation. A smaller distance between the induction coil and the heating element leads to a higher temperature of the heating element. By providing a conical coil, a heat gradient is generated in the heating element during operation of the induction heater. Preferably, the diameter of the induction coil increases from a proximal end of the chamber. Then, the temperature of the heating element is highest at the tip of the heating element.

The chamber may comprise at least one heating element. The heating element may be integrally connected with the aerosol-generating device. Alternatively, the heating element may be part of the aerosol-generating article. For example, the heating element may be provided as electrically conductive particles or filaments in the article.

Aerosol-forming substrate containing tobacco may be provided in the form of an aerosol-generating article. The aerosol-generating article may be provided as a consumable such as a tobacco stick. In the following, the aerosol-generating article will be denoted as a consumable. These consumables may have an elongate rod-like shape. A consumable is typically pushed into the chamber of the device at the proximal end of the device. This end is the mouth end of the chamber into which the consumable is inserted. In the chamber, the heating element of the induction heater is configured to penetrate the consumable. Also, the heating element may be comprised in the consumable itself. After use, the consumable is removed and replaced by a new consumable.

The heating element may be a solid, elongate heating element, extending into the chamber in a longitudinal direction of the chamber, configured to penetrate an aerosol-generating article received in the chamber. The heating element and coil may have a predefined length. The heating element may have the same length as the coil. The heating element may have the shape of a pin or blade. The heating element may be solid while the coil may have a helical shape such that the heating element can be arranged within the coil. The coil may have a frustoconical shape. The coil may be provided as a helical wound coil with the shape of a conical shaped helical spring. The coil may comprise contact elements such that an AC current can flow through the coil from the power supply. The AC current supplied to the induction coil is preferably a high frequency AC current. For the purpose of this application, the term "high frequency" is to be understood to denote a frequency ranging from about 1 Megahertz (MHz) to about 30 Megahertz (MHz) (including the range of 1 MHz to 30 MHz), in particular from about 1 Megahertz (MHz) to about 10 MHz (including the range of 1 MHz to 10 MHz), and even more particularly from about 5 Megahertz (MHz) to about 7 Megahertz (MHz) (including the range of 5 MHz to 7 MHz). No direct or electrical connection needs to be established between the coil and the heating element, since the magnetic field generated by the coil penetrates the heating element and thereby heats the heating element by the mechanisms explained above. These mechanisms are eddy currents and hysteresis losses, which are converted into heat energy. The coil as well as the heating element may be made from a conductive material such as metal. The heating element and the coil may have a circular, elliptical or polygonal shaped cross-section. The shape of the heating element may be utilized to change the shape of a consumable during insertion of the consumable into the chamber. Providing a coil with a conical shape means that the sides of the conical shaped coil are inclined with respect to the longitudinal axis of the coil. When referring to the heating element, the coil and the chamber, the term 'longitudinal' refers to the direction in which the aerosol-generating article is inserted into the chamber and the term 'transverse' refers to a direction perpendicular to the direction in which the aerosol-generating article is inserted into the chamber.

The heating element may also have a conical shape. The heating element and the induction coil may have a corresponding shape such that the heating element can be arranged within the coil. A corresponding conical shape further means that the outer shape of the heating element and the shape encompassed by the coil both resemble a cone. The outer shapes of the heating element and the coil may be straight or slightly curved. By providing a coil and heating element with a corresponding conical shape, the heating properties of the heating element can be controlled. Also, by providing a conical shaped heating element, the cleaning properties of the heating element may be enhanced. In this regard, upon removing the consumable, residues of aerosol-forming substrate may stick to the heating element and impair the functionality of the heating element. Such residues may affect subsequent aerosol generation and are thus unwanted. By providing a conical shaped heating element, pushing a consumable over the heating element is simplified and less force is required to do so since the substrate of the consumable can be penetrated more easily. In addition, provision of a conical shaped heating element may reduce the amount of loose tobacco left behind in the device upon removal of the consumable, due to the reduced friction between the conical shaped heating element and the tobacco substrate. Also, manually cleaning the heating element may be easier due to the fact that the base of the heating element can be reached easier.

The heating element and the coil may have the same longitudinal axis such that the heating element is arranged surrounded by the coil in a central position. The angle between the longitudinal axis and the sides of the heating element seen from the proximal end of the device is denoted as apex angle of the heating element. Similarly, the angle between the longitudinal axis and the sides of the coil is denoted as apex angle of the coil. Configuring the heating element and the coil such that the distance between the two perpendicular to the surface of the heating element is essentially the same means that the apex angle of the two is essentially the same. Varying the distance between the heating element and the coil means that the apex angle of the heating element is different from the apex angle of the coil. Both the heating element and the induction coil may have a positive apex angle such that the heating element and the coil have a corresponding conical shape and the same orientation with respect to the conical shape.

The apex angle of the heating element may be essentially the same as the apex angle of the induction coil. In this way, homogeneous eddy currents may be generated throughout the heating element such that the heating element may be heated to a constant temperature.

Also, the apex angles of the induction coil and the heating element may be different to facilitate a heating gradient in the heating element during operation of the induction heater. By changing the apex angle of the heating element and the coil, the heating characteristics of the heating element can be controlled. In this case, the eddy currents created in the heating element and hysteresis effects may vary from the tip to the base of the heating element.

If it is desired that the tip of the heating element is heated to a higher temperature than the base of the heating element, the apex angle of the heating element is chosen smaller than the apex angle of the induction coil. In other words, the distance between the heating element and the coil may be chosen to be smaller at the tip of the heating element and larger at the base of the heating element, which means in a direction transverse to the longitudinal direction at the tip of the heating element. A tip of the heating element with a higher temperature may be preferred to heat substrate deep within the consumable and away from the tip of the consumable. The substrate inside the consumable may benefit from increased heating since it may be more tightly packed and denser, and may also be less dry since exposed to less ambient air.

The apex angle of the heating element may also be chosen to be larger than the apex angle of the coil. Consequently, the distance between the heating element may be chosen to be larger at the tip of the heating element than at the base of the heating element, which means in a direction transverse to the longitudinal direction at the base of the heating element. As a consequence, the tip of the heating element is heated to a temperature which is lower than the temperature to which the base of the heating element is heated. Heating the tip to a lower temperature than the base of the heating element may be beneficial in that the tip of an inserted consumable is in this case heated less and therefore may dry out less. This may reduce the amount of residues left behind in the device as the depleted consumable is removed from the device.

The chamber may have the shape of a slot or cavity corresponding to the shape of a consumable. The heating element may have an elongate shape such to penetrate the consumable. The heating energy emitted by the heating element during operation of the induction heater may be evenly distributed into the substrate of the consumable.

The induction coil of the induction heater may be arranged around the heating element within the housing. In this way, the coil may be protected from contamination for example by aerosol-forming substrate. The housing which constitutes the confinement for the coil may be made from material not susceptible to being heated, when penetrated by an alternating magnetic field. For example, the housing may be made from a non-conductive material such that no eddy currents are generated in the housing, and which is also not heatable through hysteresis mechanisms. In other words, the housing may be made from a non-susceptor material, for example a non-conductive, non-susceptor material. The whole housing of the device may be made from a non-conductive material. Alternatively, the section of the housing adjacent to the induction coil may be made from a non-conductive material.

The heating element may have a tapered free end. The free end is also denoted as tip of the heating element. By means of the tapered tip, the insertion of the consumable may be facilitated and the consumable may not be damaged during insertion. A tapered tip refers to a small section adjacent to the tip of the heating element. Contrarily, a conical shape refers to a substantial length of the element adjacent from the tapered tip of the element to the base of the element. A conical shape may be present if at least 50 percent, at least 70 percent or at least 90 percent of the length of the element resembles a cone. A conical shape may be present if the element resembles a cone over the whole length.

At least one air inlet may be provided at the side of the housing such that air can be drawn through the air inlet and emitted adjacent to the heating element. Alternatively, at least one air inlet is provided at the chamber of the housing such that air can be drawn through the air inlet next to an inserted consumable and emitted adjacent to the heating element. The air inlet may be formed as a groove in the chamber such that the consumable may be firmly held in the chamber or the diameter of the chamber may be larger than the diameter of a consumable. Air which is drawn into the device by the puff of a user may be drawn through the consumable adjacent to the heating element, and a heating action of the heating element may create an aerosol which is then inhaled by a user.

The chamber may resemble the shape of the consumable. The chamber may aid in holding the consumable over or inside of the heating element. The chamber may have a diameter which corresponds to the diameter of a consumable or be slightly smaller.

The heating element may comprise multiple heating elements. In all embodiments, a single heating element or multiple heating elements may be employed. Different sections of the heating element may be independently heatable by providing multiple heating elements. Multiple independently controllable induction coils may be provided for heating the multiple heating elements. One induction coil may be assigned to one heating element and AC current may be directed through one coil at a time to heat the respective heating element. The induction coils may be provided with separate contacting terminals for separately contacting the coils with the power supply. The different heating elements may be heated to different temperatures. For example, different materials with different electrical resistances may be employed for the different heating elements. The coils may be made from different materials with different electrical resistances. If multiple coils are employed, AC current of different strength may be directed through the different coils. Different pitches may be employed in the different coils. The pitch of the coil denotes the spacial distance between individual windings of the coil. These different configurations of the induction coil or coils may be utilized to control the generation of the magnetic field and thereby the heating of the heating element.

As described above, the heating element may have an elongate cylindrical, preferably solid, shape such a consumable can be easily penetrated. Alternatively, the heating element may be a hollow heating element comprising an internal cavity, configured to receive an aerosol-generating article received in the chamber in the internal cavity. By means of the hollow shape, a consumable may thus be pushed inside of the heating element. The hollow heating element may have a slightly bend or curved surface to facilitate insertion of the consumable. Thus, the heating element may have a conical shape with a slightly curved outer surface. The consumable may in this case be sandwiched in the internal cavity of the hollow heating element such that the consumable is held inside of the heating element by a press fit. The heat transferred from the heating element into the substrate of the consumable may be optimized, since the substrate in the consumable may be compressed and the distance between the heating element and the substrate may be minimized.

When the heating element is hollow, the consumable may be pushed into the internal cavity of the heating element. The shape of the consumable may change during insertion due to the cross section of the hollow heating element. In this way, the heating of the aerosol-forming substrate in the consumable may be further optimized. For example, an elliptical cross-section of the heating element may be utilized to flatten the aerosol-forming substrate during insertion of the consumable.

The hollow heating element may have a subsequently decreasing diameter seen from the proximal end of the device. Multiple hollow heating elements may have a successively decreasing diameter. The decreasing diameter may facilitate the insertion of the consumable and the consumable may be held securely within the device. The heating element may have the largest diameter at the tip which is firstly contacted by the consumable upon insertion of the consumable into the internal cavity of the heating element and the smallest diameter at the base of the heating element.

The controller may comprise a microprocessor, which may be a programmable microprocessor. The controller may comprise further electronic components. The controller may be configured to regulate a supply of electric power to the induction heater. Electric power may be supplied to the induction heater continuously following activation of the device or may be supplied intermittently, such as on a puff-by-puff basis. The power may be supplied to the induction heater in the form of pulses of electrical current.

The power supply may be a battery. As an alternative, the power supply may be another form of charge storage device such as a capacitor. The power supply may require recharging and may have a capacity that allows for the storage of enough energy for one or more puffs; for example, the power supply may have sufficient capacity to allow for the continuous generation of aerosol for a period of around six minutes or for a period that is a multiple of six minutes. In another example, the power supply may have sufficient capacity to allow for a predetermined number of puffs or discrete activations of the induction heater.

The aerosol-forming substrate may comprise homogenised tobacco material. The aerosol-forming substrate may comprise an aerosol-former. The aerosol-forming substrate preferably comprises homogenised tobacco material, an aerosol-former and water. Providing homogenised tobacco material may improve aerosol generation, the nicotine content and the flavour profile of the aerosol generated during heating of the aerosol-generating article. Specifically, the process of making homogenised tobacco involves grinding tobacco leaf, which more effectively enables the release of nicotine and flavours upon heating.

The induction heater may be triggered by a puff detection system. Alternatively, the induction heater may be triggered by pressing an on-off button, held for the duration of the user's puff.

The puff detection system may be provided as a sensor, which may be configured as an airflow sensor and may measure the airflow rate. The airflow rate is a parameter characterizing the amount of air that is drawn through the airflow path of the aerosol-generating device per time by the user. The initiation of the puff may be detected by the airflow sensor when the airflow exceeds a predetermined threshold. Preferably, initiation may also be detected upon a user activating a button.

The sensor may also be configured as a pressure sensor to measure the pressure of the air inside the aerosol-generating device which is drawn through the airflow path of the device by the user during a puff.

An aerosol-generating device as described above and a consumable may be an electrically operated smoking system. Preferably, the aerosol-generating system is portable. The aerosol-generating system may have a size comparable to a conventional cigar or cigarette. The smoking system may have a total length between approximately 30 millimetres and approximately 150 millimetres. The smoking system may have an external diameter between approximately 5 millimetres and approximately 30 millimetres.

The invention also relates to an aerosol-generating system comprising an aerosol-generating device as described above and an aerosol-generating article having an aerosol-generating substrate and configured for use with the aerosol-generating device.

FIG. 1 shows a conventional induction heater 10 with an elongate heating element 12 that is arranged within an induction coil 14. The elongate heating element 12 has a tapered tip. Apart thereof, the elongate heating element 12 as well as the induction coil 14 have a constant diameter along the longitudinal length of the elongate heating element 12 and the induction coil 14, respectively.

Figure 2:
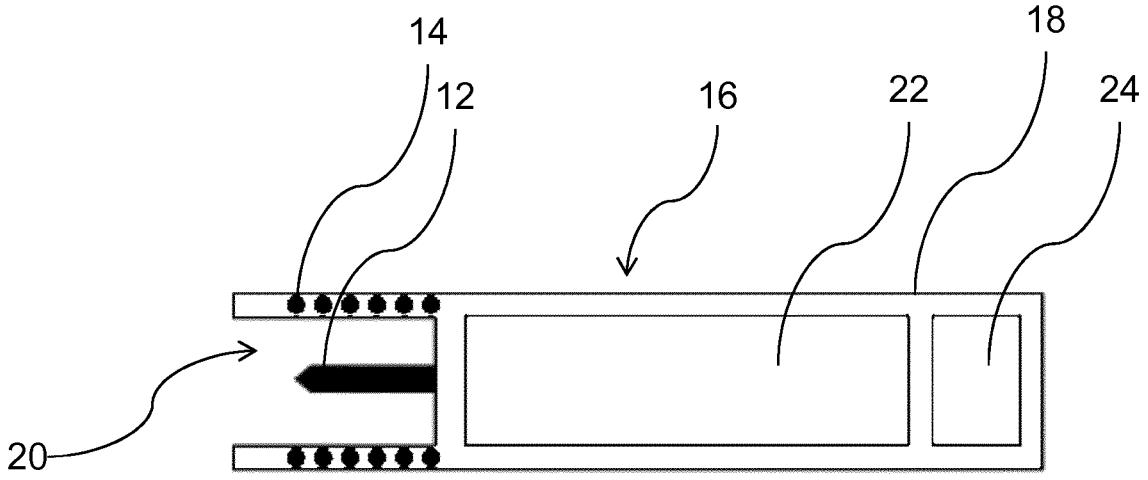
FIG. 2 shows the conventional induction heater used in an aerosol-generating device.

FIG. 2 shows the conventional induction heater 10 used in an aerosol-generating device 16. The aerosol-generating device 16 comprises a housing 18. The induction coil 14 is arranged within the housing 18. The housing 18 also comprises a chamber 20 at a proximal end in which a consumable can be inserted. In the chamber 20, the heating element 12 of the conventional induction heater 10 is arranged such that the heating element 12 can penetrate the consumable. In the housing 18 of the aerosol-generating device 16, a battery 22 is arranged as well as a controller 24 for controlling the supply of electrical power from the battery 22 to the conventional induction heater 10.

Figure 3:
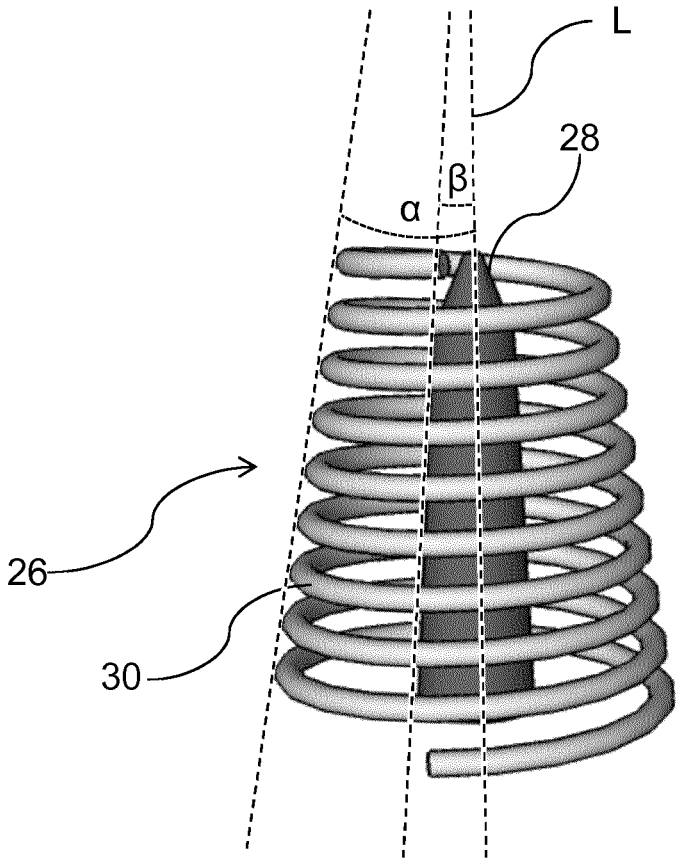
FIG. 3 shows an induction heater according to the invention.

FIG. 3 shows an embodiment of the induction heater 26 according to the invention. The induction heater 26 comprises a conical shaped heating element 28 which is surrounded by a conical shaped induction coil 30. Only the induction coil 30 may have a conical shape while the heating element 28 may not have a conical shape. The conical shaped heating element 28 has a tapered tip to facilitate the insertion of a consumable over the conical shaped heating element 28. The conical shaped heating element 28 has a conical shape from the tip of the conical shaped heating element 28 to the base of the conical shaped heating element 28.

The conical shaped induction coil 30 surrounds the conical shaped heating element 28 such that the distance perpendicular to the side surface of the conical shaped heating element 28 from the conical shaped heating element 28 to the conical shaped induction coil 30 remains essentially the same from the end of the tip of the conical shaped heating element 28 to the base of the conical shaped heating element 28. Consequently, the conical shape of the induction coil 30 corresponds to the conical shape of the heating element 28. In FIG. 3, the longitudinal axis L of the heating element 28 as well as the induction coil 30 is shown. The apex angle $\alpha$ of the induction coil 30 is depicted, which is the angle between the longitudinal axis L and the shape of the outer sides of the induction coil 30. The apex angle $\beta$ is shown which is the angle between the longitudinal axis L and the outer surface of the heating element 28. In the embodiment shown in FIG. 3, the apex angle $\alpha$ is essentially the same as the apex angle $\beta$.

Figures 4A, 4B, 4C:
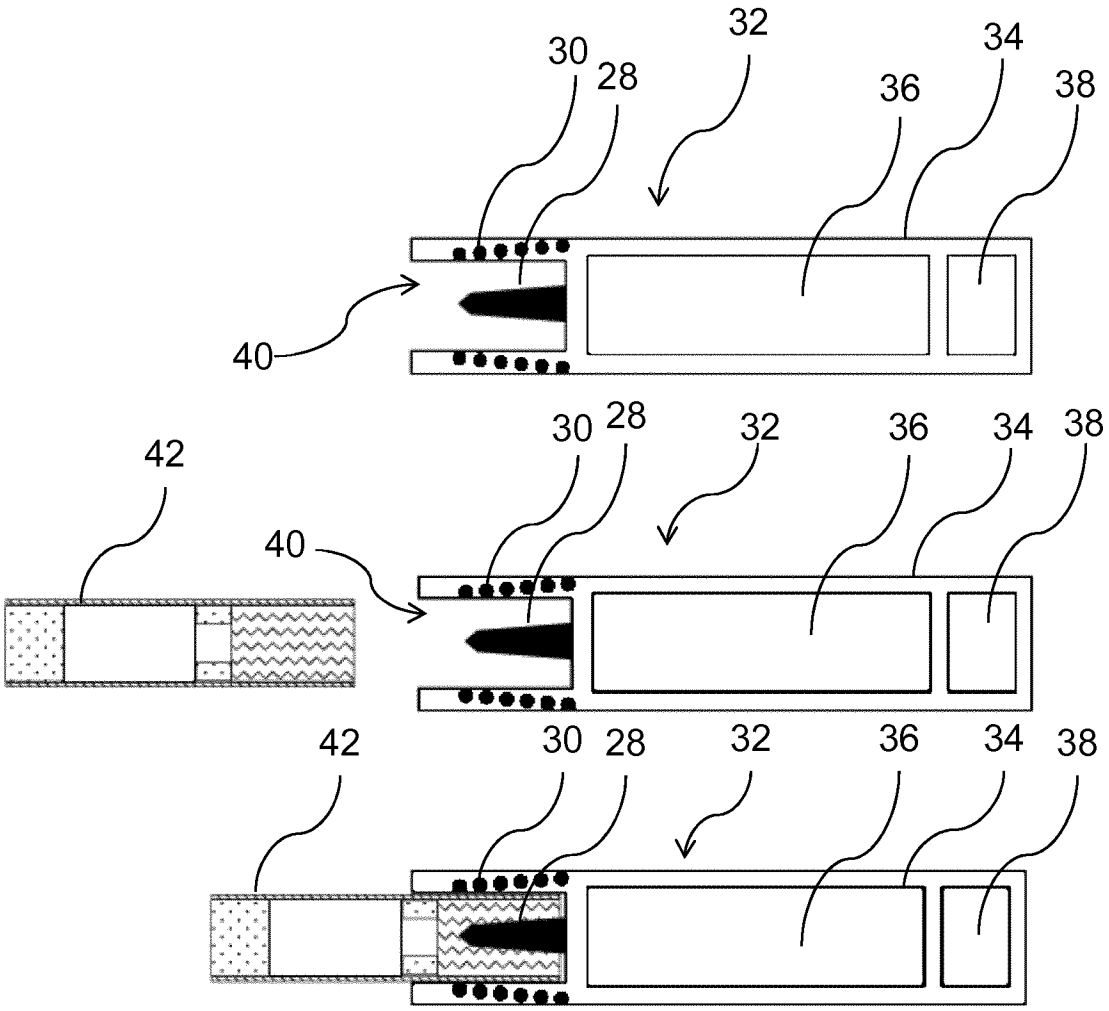
FIG. 4 shows the induction heater according to the invention used in an aerosol-generating device.

FIG. 4 shows in FIG. 4*a* the induction heater 26 used in an aerosol-generating device 32. The aerosol-generating device 32 comprises a housing 34 encompassing a battery 36 and a controller 38. Also, a chamber 40 at a proximal end is provided in the housing in which a consumable 42 can be placed. The induction heater 26 is placed near the chamber 40. In more detail, the conical shaped heating element 28 is arranged in the chamber 40 such that a consumable 42 can be pushed easily over the conical shaped heating element 28 due to less friction occurring while pushing the consumable over the conical shaped side surface of the conical shaped heating element 28. The conical shaped induction coil 30 of the induction heater 26 is arranged protected within the housing 34 around the conical shaped heating element 28. In this way, only the conical shaped heating element 28 is accessible from the outside without opening the housing 34. The conical shaped heating element 28 can be cleaned without interfering with the further components of the aerosol-generating device 32.

In FIG. 4*b*, the consumable 42 comprising aerosol-forming substrate is shown before being inserted into the chamber 40 of the aerosol-generating device 32. The consumable 42 is plugged into the chamber 40 by pushing the consumable 42 over the tip of the conical shaped heating element 28 until the consumable 42 reaches the base of the conical shaped heating element 28. In FIG. 4*c*, the consumable 42 is fully pushed into the chamber 40 of the aerosol-generating device 32.

Figures 5A, 5B:
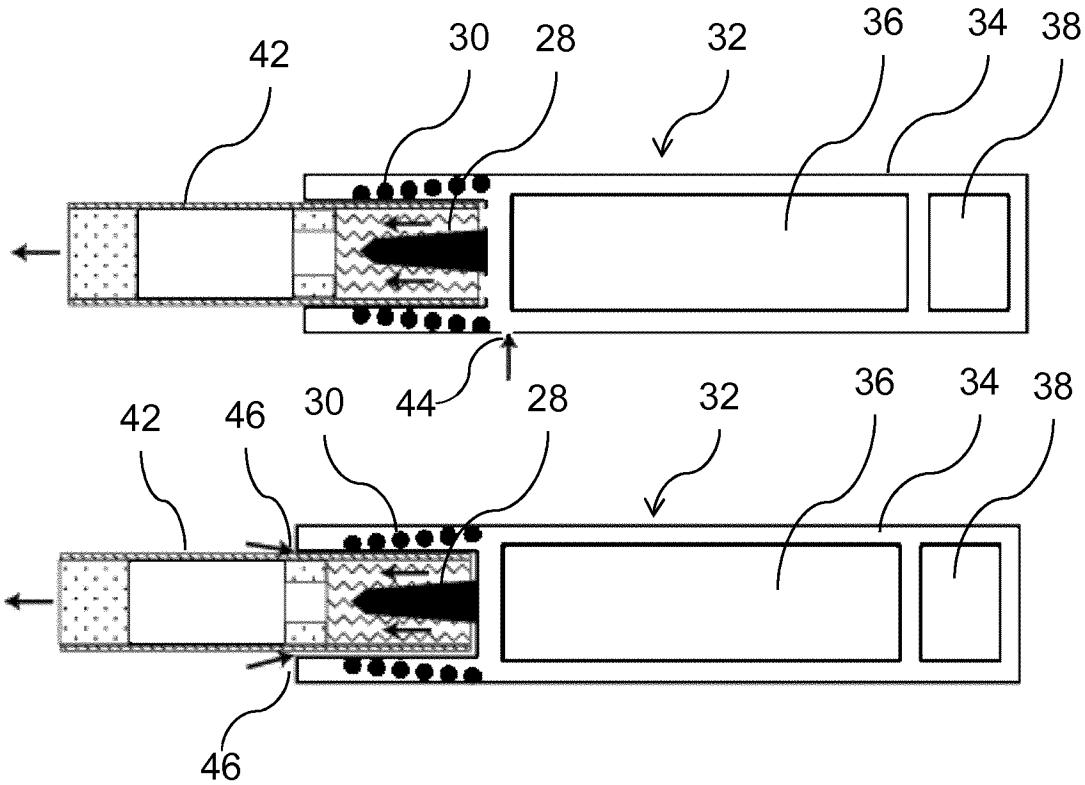
FIG. 5 shows air inlets used in the aerosol-generating device.

FIG. 5 shows two embodiments of air inlets for the aerosol-generating device 32. In FIG. 5*a*, an air inlet 44 is shown which is provided at a side surface of the aerosol-generating device 32. The air inlet 44 allows ambient air to be drawn through the aerosol-generating device 32 and being expelled through the consumable 42. In this way, the length of the air flow path within the device 32, from the air inlet to the heating element may be minimized.

In FIG. 5*c*, a different configuration of an air inlet 46 is depicted. In this embodiment, ambient air can enter into the aerosol-generating device 32 next to the consumable 42 through the chamber 40. The air inlet 46 is realized by a groove in the chamber 40. Thus, no air inlets are necessary at the side surface of the device 32 such that the overall construction of the device 32 is simplified and it stability is increased.

Figure 6A:
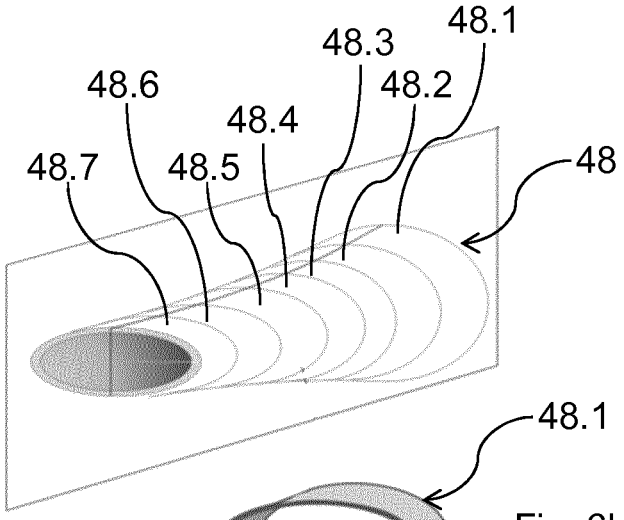
FIG. 6 shows a heating element of the induction heater comprising multiple heating elements and having an elliptical shape.

FIG. 6 shows the heating element of the induction heater 26 being provided as a conical shaped heating element 48. The heating element 48 is hollow and has an elliptical cross-section. In FIG. 6*a*, the conical shaped elliptical heating element 48 is depicted. This heating element 48 comprises multiple heating elements 48.1, 48.2, 48.3, 48.4, 48.5, 48.6, 48.7. The heating elements 48.1 to 48.7 can be separately heated. The heating elements 48.1 to 48.7 can be made from different materials. Individual inductions coils may be provided around each of the heating elements 48.1 to 48.7 to facilitate an individual heating action. The heating elements 48.1 to 48.7 have a conical shape such that the diameter decreases from the first heating element 48.1 to the last heating element 48.7.

Figure 6B:
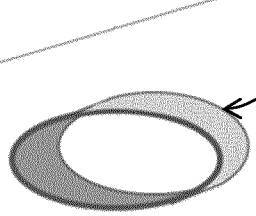
Figure 6C:
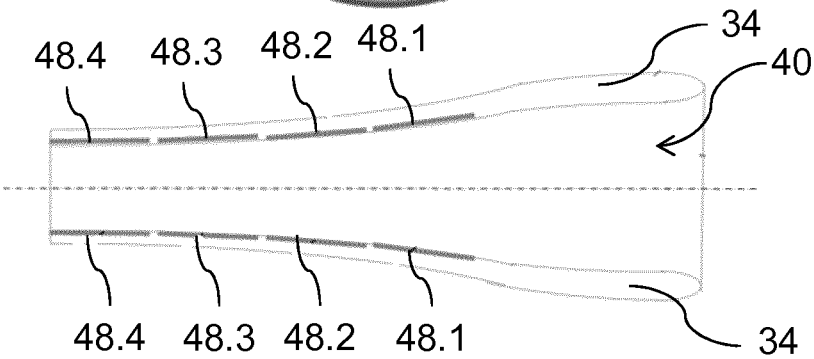

In FIG. 6*b* a single heating element 48.1 is shown. In FIG. 6*c* the conical shaped elliptical heating element 48 is shown arranged along the side surface of the chamber 40 of an aerosol-generating device 32. The conical shaped elliptical heating element 48 may be arranged inside of the chamber 40 of the aerosol-generating device 32 as a separate element. Alternatively, the heating element 48 may be configured as an integral part of the chamber 40 to form the side surface of the chamber 40. The conical shaped elliptical heating element 48 is formed such that a low insertion force for pushing a consumable 42 in an internal cavity of the conical shaped elliptical heating element 48 reshapes the cross-section of the consumable 42 to a predominantly elliptical cross-section. An elliptical cross-section of the consumable 42 may facilitate an optimized heat transfer from the conical shaped elliptical heating element 48 to the consumable 42, as the thickness of the consumable 42 is reduced.

Figure 7:
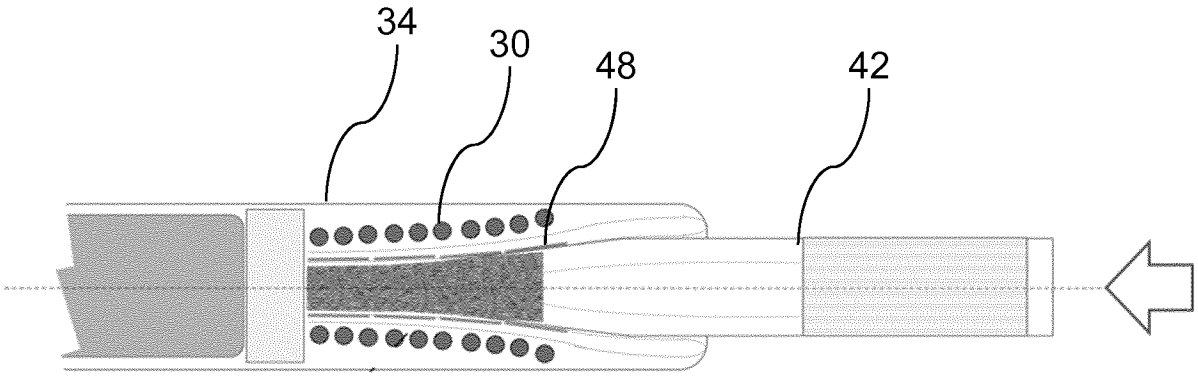
FIG. 7 shows a heating element of the induction heater comprising multiple heating elements and having an elliptical shape used in the aerosol-generating device.

FIG. 7 shows the embodiment depicted in FIG. 6, wherein a consumable 42 has been pushed inside of the internal cavity of the conical shaped elliptical heating element 48. An induction coil 30 is arranged protected within the housing 34 of the aerosol-generating device 32 and surrounds the conical shaped elliptical heating element 48.

The invention is not limited to the described embodiments. The skilled person understands that the features which are described in the context of the different embodiments can be combined with each other within the scope of the invention.

The invention claimed is:

1. An aerosol-generating device, comprising:

a housing having a chamber configured to receive at least a portion of an aerosol-generating article, wherein the chamber comprises at least one heating element;

an induction coil disposed around at least a portion of the chamber and having a conical shape; and a power supply and a controller connected to the induction coil and configured to provide an alternating electric current to the induction coil such that the induction coil generates a fluctuating magnetic field to heat the heating element located in the chamber, wherein the heating element is a hollow heating element comprising an internal cavity, and wherein the heating element is configured to receive the aerosol-generating article received in the chamber in the internal cavity.

2. The aerosol-generating device according to claim 1, wherein the heating element has a conical shape.

3. The aerosol-generating device according to claim 2, wherein the hollow heating element has a slight bend or curved surface configured to facilitate insertion of the aerosol-generating article.

4. The aerosol-generating device according to claim 2, wherein an apex angle of the conically shaped induction coil is essentially the same as an apex angle of the conically shaped heating element.

5. The aerosol-generating device according to claim 2, wherein an apex angle of the conically shaped induction coil differs from an apex angle of the conically shaped heating element.

6. The aerosol-generating device according to claim 1, wherein the housing comprises at least one air inlet at a side of the housing.

7. The aerosol-generating device according to claim 1, wherein the hollow heating element has a subsequently decreasing diameter as viewed from a proximal end of the device.

8. The aerosol-generating device according to claim 1, wherein the induction coil has a subsequently decreasing diameter as viewed from a proximal end of the device.

9. The aerosol-generating device according to claim 1, wherein the hollow heating element has an elliptical cross-section.

10. The aerosol-generating device according to claim 1, wherein the chamber comprises two or more heating elements.

11. The aerosol-generating device according to claim 10, wherein the heating elements are made from different materials.

12. The aerosol-generating device according to claim 10, wherein the chamber comprises multiple hollow heating elements having a successively decreasing diameter.

13. The aerosol-generating device according to claim 1, wherein a wall of the internal cavity is formed by the heating element.

14. An aerosol-generating system, comprising:

an aerosol-generating device according to claim 1; and an aerosol-generating article having an aerosol-generating substrate and configured for use with the aerosol-generating device.

15. The aerosol-generating system according to claim 14, wherein the heating element is shaped such that the aerosol-generating article is sandwiched in a press fit in the internal cavity of the heating element, when the aerosol-generating article is received in the chamber.

* * * * *